United States Patent [19]

Newell et al.

[11] Patent Number: 5,039,177

[45] Date of Patent: Aug. 13, 1991

[54] CABINET WITH PANEL-ATTACHMENT CORNER DETAIL

[75] Inventors: Charles R. Newell, Grand Haven; Alan R. Wright, Wyoming; Ronald V. Korsky, Rockford; Jeffrey Reuschel, Hamilton; Stephen B. Greenman, Holland; Craig C. Chopp, Allegan, all of Mich.

[73] Assignee: Haworth, Inc., Holland, Mich.

[21] Appl. No.: 547,760

[22] Filed: Jul. 2, 1990

[51] Int. Cl.[5] ..... H16B 12/00

[52] U.S. Cl. ..... 312/111; 312/263; 160/135; 52/282; 52/288

[58] Field of Search ..... 403/440; 160/135; 312/263, 111, 257.1, 107; 52/282, 287, 288

[56] References Cited

U.S. PATENT DOCUMENTS

| | | | |
|---|---|---|---|
| 3,574,433 | 4/1971 | Bell | 312/111 |
| 4,192,106 | 3/1980 | Hell | 160/135 X |
| 4,378,137 | 3/1983 | Gibson et al. | 312/111 X |
| 4,470,647 | 9/1984 | Bishoff et al. | 312/111 |

*Primary Examiner*—Joseph Falk

*Attorney, Agent, or Firm*—Flynn, Thiel, Boutell & Tanis

[57] ABSTRACT

A furniture component, such as a cabinet structure, having corner recesses extending vertically of the cabinet structure and each adapted to receive a vertically elongate corner trim element. The corner trim element preferably has a rounded convex configuration on one side thereof, and a generally square corner configuration on the other side thereof. The corner trim element can be positioned in the respective recess in two different orientations so that either the rounded or square corner configurations can be exteriorly exposed. When the square corner configuration is exposed, then the corner trim element also defines therein an accessible vertically elongate groove which accommodates one-half of a connecting element, such as a vertical hinge element, for permitting the corner of the cabinet to be secured to another furniture component, such as another cabinet or an upright wall panel.

16 Claims, 4 Drawing Sheets

CABINET WITH PANEL-ATTACHMENT CORNER DETAIL

FIELD OF THE INVENTION

This invention relates to a furniture component such as storage cabinet having an improved corner structure, specifically a removable corner trim element, for permitting multiple use configurations including attachment to an adjacent furniture component such as a wall panel.

BACKGROUND OF THE INVENTION

Conventional furniture storage components such as file cabinets, shelving units, bookcases and the like typically have corners defined either directly by the cabinet walls or by separate corner pieces which are permanently and fixedly secured to the walls by appropriate fastening arrangements. These structures, however, do not provide for multiple use orientations of the corner trim detail, and in particular do not permit attachment to an adjacent furniture component such as an adjacent cabinet or panel. When cabinets of this type are utilized in offices which employ "Systems" furniture, namely large open office areas which are divided into smaller work areas by series of joined space dividing panels, the cabinets typically are utilized in the work areas as wholly freestanding units which are positioned adjacent but in front of one of the panels, and as such the cabinet can not be integrated into the panel system. This results in the panel system and cabinet utilizing a greater floor area, and additionally requires use of a sufficient number of panels to effectively divide or separate the adjacent work areas since the cabinets merely sit in front of the panels and are not effective for performing a dividing or separating function.

Accordingly, the present invention relates to an improved furniture component, such as a storage cabinet, which is particularly desirable for use in association with Systems-type furniture so as to provide highly-increased flexibility with respect to the creation and rearrangement of the Systems furniture, and particularly for permitting minimization in the use of floor space and minimization in the required number of panels by permitting the cabinet structure itself to be securely incorporated directly into a run of panels so as to also perform a separating or dividing function between adjacent work areas.

With the improved cabinet arrangement of the present invention, the cabinet employs a removable corner structure which has multiple selectable orientations so as to provide for multiple use functions, thereby providing significantly increased versatility and flexibility with respect to use of the cabinet and its cooperation with the overall associated Systems furniture.

In a preferred embodiment, the furniture cabinet is provided with an improved corner structure associated with one, and preferably all of the corners thereof. This cabinet structure includes an elongated outwardly opening recess associated with and extending longitudinally along each vertical corner of the cabinet, which recess removably receives therein a vertically extending corner element. The corner element can be positioned in the recess in any one of several selected orientations so that different side faces of the corner element are exposed. This corner element in the preferred embodiment is longitudinally slidably inserted into and retained in the recess. The corner element has one exposeable side face which is configured to provide an exposed corner surface, particularly a rounded surface, when the corner is intended to be positioned in spaced association from other components. By orienting the corner member in another selectable position, then other side faces of the corner member are exposed, and one of these is provided with an elongate groove for accommodating one half of a securing element, such as a hinge element, which securing element in turn can have the other half thereof secured to another furniture component such as a space dividing panel.

Other objects and purposes of the present invention will be apparent to persons familiar with structures of this general type upon reading the following specification and inspecting the accompanying drawings.

Figure 1:
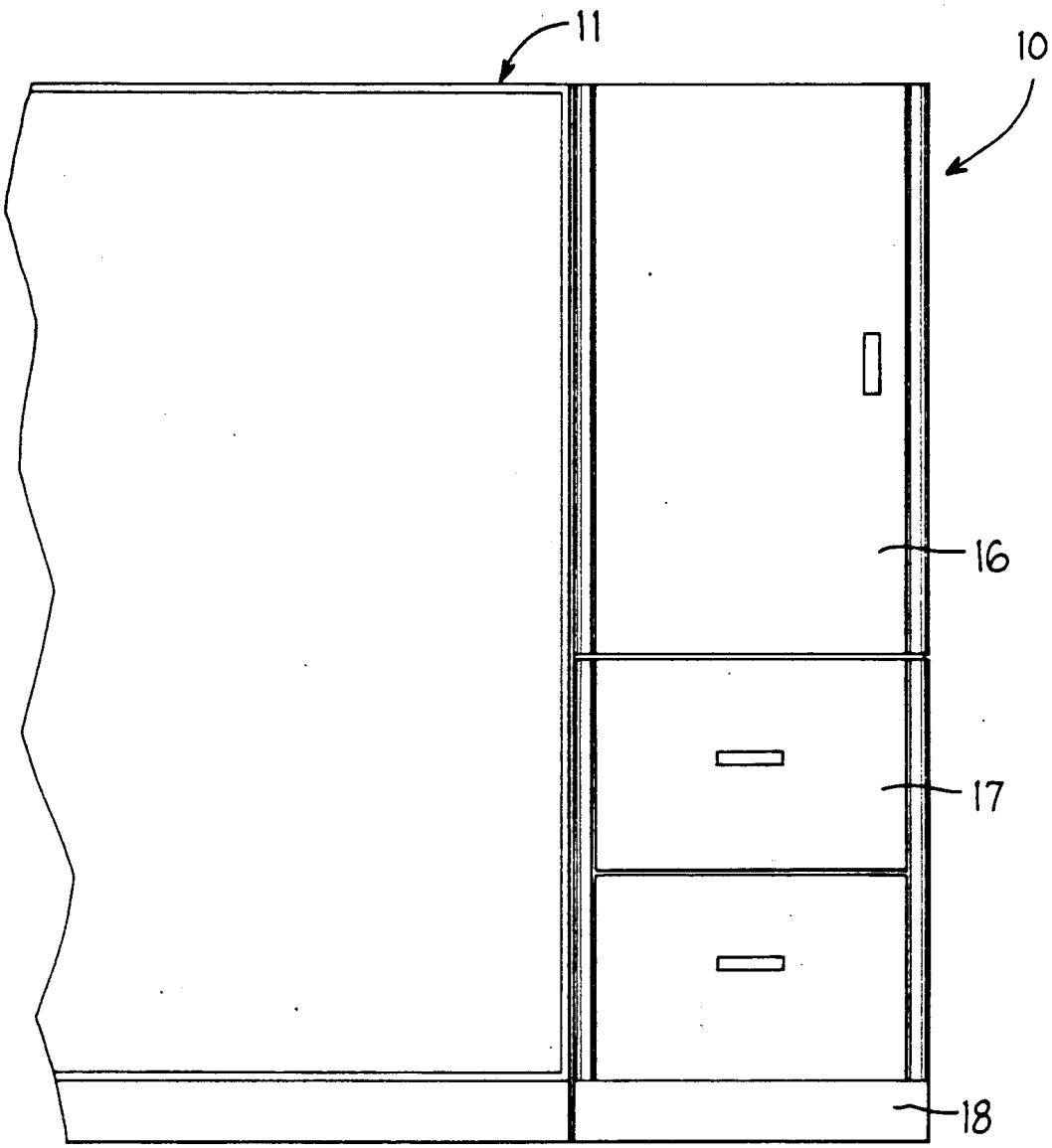
FIG. 1 is a fragmentary elevational view showing a storage cabinet of the present invention connected to an adjacent edge of an upright space dividing panel.

In the following description, certain terminology will be used for convenience in reference only, and will not be limiting. For example, the words "upwardly", "downwardly", "rightwardly" and "leftwardly" will refer to directions in the drawings to which reference is made. Said terminology will also refer to the conventional orientation of the cabinet structure. The terminology "inwardly" and "outwardly" will refer to directions toward and away from, respectively, the geometric center of the cabinet structure and designated parts thereof. Said terminology will include the words specifically mentioned, derivatives thereof, and words of similar import.

DETAILED DESCRIPTION

Figure 2:
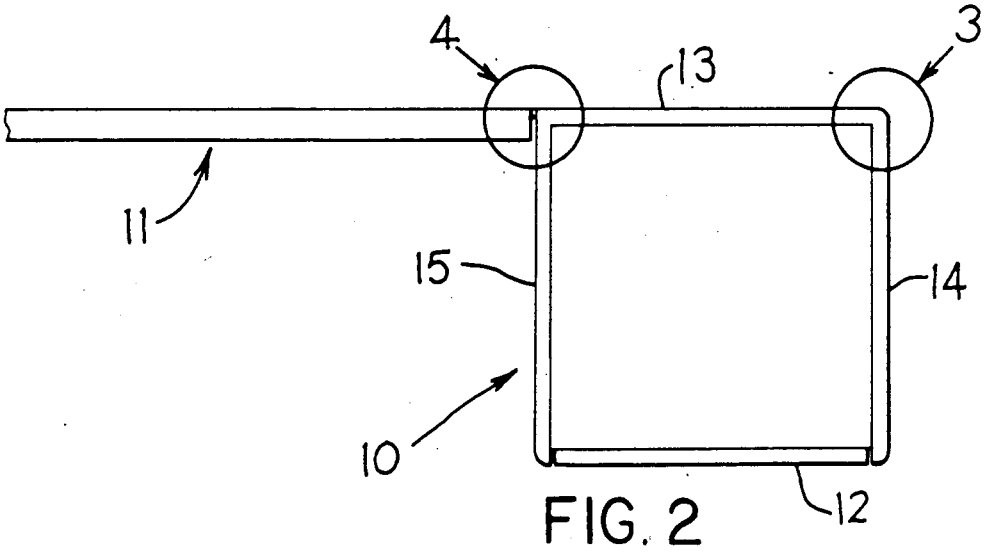
FIG. 2 is a fragmentary top view outlining the arrangement of FIG. 1.

Referring to FIGS. 1 and 2, there is illustrated an upright freestanding furniture component 10, specifically a cabinet structure, positioned adjacent one edge of an upright spaced divider panel 11. The cabinet structure 10 includes generally parallel front and back sides 12 and 13 respectively, joined together by generally parallel right and left sides 14 and 15 respectively, whereby the cabinet structure has a generally rectangular configuration in plan view. In the illustrated embodiment the back, right and left sides are defined by walls which partially or totally close off that vertical side of the cabinet, whereas the front side 12 is defined an enlarged opening for permitting access to the interior of the cabinet structure, which access opening accommodates therein an openable door 16 and a pair of drawer fronts 17. The latter arrangement is solely for purposes of illustration since it will be appreciated that numerous variations and/or combinations of doors, drawers and/or openings can be provided so as to provide whatever type of interior storage is desired.

In the illustrated embodiment, the cabinet structure 10 is supported on a base 18 which in turn rests on the floor, although it will be appreciated that in many instances the base will be eliminated and the cabinet structure configured so as to be supported substantially directly on the floor.

Figure 7:
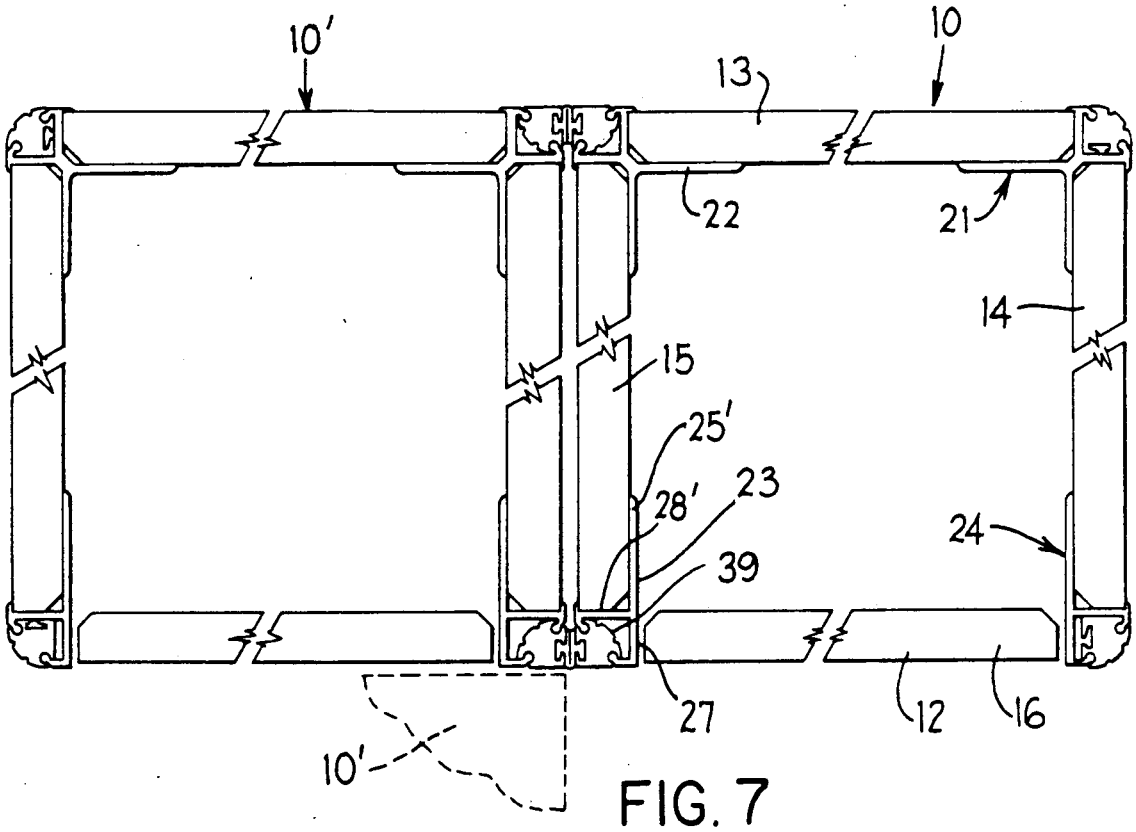
FIG. 7 is a fragmentary plan view, in cross section, and showing two substantially identical cabinet structures positioned in adjacent side by side relationship and joined together.

As illustrated by FIG. 7, the cabinet structure 10 includes a pair of identical corner brackets 21 and 22 which are associated with the rear corners for permitting rigid securement between the rear wall 13 and the respectively adjacent side wall 14 or 15. These corner brackets 21 and 22 extend vertically throughout substantially the full height of the cabinet structure.

A further pair of substantially identical corner brackets 23 and 24 are associated with the front corners of the cabinet structure and, like the corner brackets 21–22, the brackets 23–24 also extend vertically throughout substantially the complete height of the cabinet structure. These corner brackets 23–24 also rigidly secure to the respective side wall 14 or 15, but are of a slightly different structure from the brackets 21–22 so as to accommodate the access opening associated with the front side 12 of the cabinet. This will be explained in greater detail hereinafter.

Figure 3:
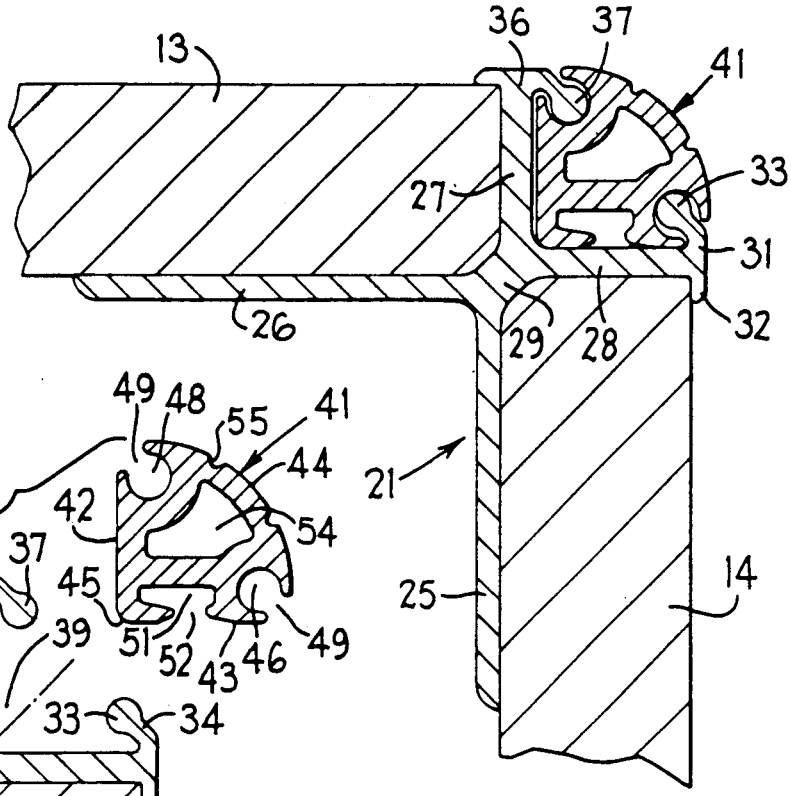
FIG. 3 is an enlarged fragmentary sectional view of the circled area designated "3" in FIG. 2.
Figure 3A:
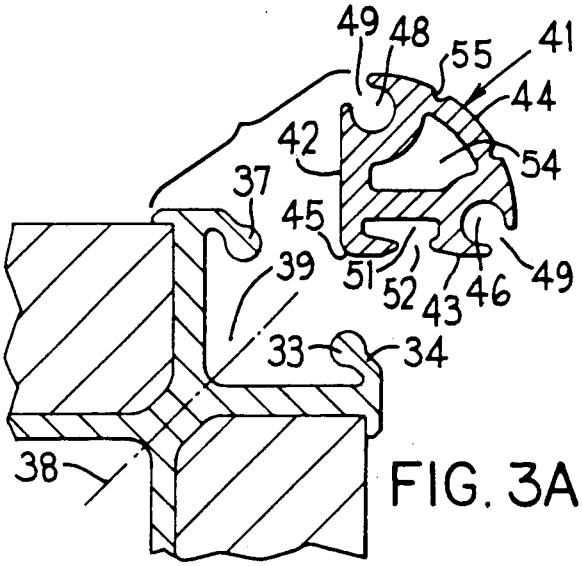
FIG. 3A is a view corresponding to FIG. 3 but showing the corner bracket and corner element in separated condition.

Considering now the construction of the corner bracket 21, and referring to FIGS. 3 and 3A, this bracket includes a pair of platelike legs 25 and 26 which extend generally in perpendicular relationship to one another and overlie the inner surfaces of the respective walls 14 and 13, with these plates 25 and 26 being secured in a conventional manner to the respective side wall, such as by means of screws (not shown).

Corner bracket 21 also includes a further pair of generally perpendicularly extending platelike legs 27 and 28 which are positioned so as to substantially directly overlie the vertical edges of the respective wall panels 13 and 14. These platelike legs 27 and 28 are respectively generally parallel with and project outwardly in the opposite directions from the respective platelike legs 25 and 26, with the pair of legs 27–28 being joined to the pair of legs 25–26 through a short apex portion 29 which is positioned directly between the adjacent inner corners of the wall panels 13 and 14. The corner bracket 21 thus has a generally X-shaped configuration when viewed in cross section, although the leg 27 is displaced sidewardly in an outward direction relative to the plane of the leg 25, and similarly the leg 28 is spaced sidewardly a small extent in an outward direction relative to the plane of the leg 26.

The platelike leg 28 has a flange 31 fixed thereto and extending transversely thereacross adjacent the outer free end thereof, which flange 31 extends vertically (i.e., longitudinally) throughout the complete lengthwise extent of the corner bracket. This flange 31 includes a small projection 32 which projects sidewardly in one direction so as to partially overlap by a small extent the front surface of the adjacent side panel 14. This projection 32 and its cooperation with the platelike legs 25 and 28 define a shallow channel for receiving and confining the adjacent vertical edge of the side panel 14.

The front flange 31 also has a securing rib 33 projecting sidewardly in opposite direction from the projection 32. This securing rib 33 is cantilevered outwardly from the side of the respective platelike leg 28 and terminates in a rounded enlargement adjacent the free end thereof, which rounded enlargement joins to the flange through a reduced-width neck part 34.

The other platelike leg 27 also has a flange 36 fixedly secured to and extending transversely adjacent the outer or free edge thereof. This flange 36 is identical to the flange 31 and again includes a sidewardly extending securing rib 37 having a configuration which is generally identical to that of the securing rib 33. These securing ribs 33 and 37 project inwardly generally directly toward one another in opposed relationship.

As illustrated by FIGS. 3 and 3A, the corner bracket 21 is generally symmetrical about the vertical plane 38 which extends centrally through the apex portion 29 and generally bisects the 90° angles defined between the cooperating pairs of legs 25–26 and 27–28. The cooperating pair of legs 27–28 define therebetween a corner recess 39 which opens generally outwardly of the cabinet between the opposed securing ribs 33 and 37.

As noted above, the other corner bracket 22 is identical to the corner bracket 21.

As to the corner brackets 23 and 24 (FIG. 7), each includes perpendicularly extending legs 27' and 28' which are identical to the legs 27 and 28 described above, and in addition each of the corner brackets 23 and 24 includes a platelike leg 25' which corresponds to the leg 25 and overlies and is fixedly secured to the inner surface of the adjacent side wall. The corner brackets 23 and 24, however, do not have a second platelike leg corresponding to the leg 26 since the cabinet structure, in the illustrated embodiment, is provided with an access opening in the front side thereof, which access opening is preferably provided with maximum width so that the leg 25 is eliminated from the brackets 23 and 24. The only other difference between the brackets 23–24 relative to the brackets 21–22 is that the legs 27' and 25' are disposed substantially within the same plane, rather than being slightly sidewardly offset. The corner brackets 23 and 24 otherwise structurally and functionally corresponds to the brackets 21 and 22 as described above. These corner brackets are, for convenience of manufacture, preferably of an extruded construction, such as of aluminum.

Each corner bracket is adapted to accommodate therein a removable corner trim element 41 which can be positioned within the recess 39 so as to be disposed in more than one orientation. This corner trim element 41 is also preferably of a vertically elongated construction, although the element 41 can be of shorter length than the corner bracket, and in fact several corner elements 41 can be effectively vertically stacked one above another within a single corner bracket so as to effectively occupy the overall vertical height of the recess 39.

Referring specifically to FIGS. 3 and 3A, the corner trim element 41 is of a generally three-sided cross section and includes first and second substantially straight or planar edge walls 42 and 43, respectively, which edge walls extend in approximately perpendicular relationship to one another and intersect generally at a corner 45. These generally straight or flat edge walls 42 and 43 are in turn joined together, adjacent their outer ends, by an arcuate edge wall 44 which is of a generally rounded convex configuration. This rounded or arcuate edge wall 44 extends through an angular extent of about 90° and is, in the illustrated embodiment, generated by a radius which is centered substantially at the corner 45, whereby the cross section defined by the corner element 41 resembles one-quarter of a circle.

The corner element 41 has a first groove 46 formed therein at the corner of the element where the walls 43 and 44 intersect. This groove extends longitudinally throughout the length of the corner element and is of a generally rounded cross section at the bottom thereof, with the enlarged rounded bottom of the groove opening outwardly through the side of the member by a reduced-width mouth 47. A second groove 48 is also formed in and extends longitudinally throughout the length of the corner element 41. This groove 48 is located at the corner of the element where the surfaces 42 and 44 intersect, and has a rounded enlarged bottom portion which opens outwardly through the side wall of the element 41 through a reduced width mouth 49. The grooves 46 and 48 are of identical configurations, and are oriented generally directly opposite one another on substantially diametrically opposite corners of the element 41, with the grooves opening outwardly in substantially directly opposite directions.

Corner trim element 41 also has a further groove 51 formed therein and extending longitudinally throughout the length thereof. This groove 51 has generally L- or T-shaped cross section and includes a base or mouth portion 52 which opens inwardly from the side surface 43 and which communicates with an enlarged or undercut head portion 53 which is located interiorly of the element 41. This groove 51 is associated solely with the surface 43 and is disposed between the groove 46 and the other flat surface 42. This latter flat surface 42 is generally free of grooves.

The corner element 41, in the illustrated embodiment, is manufactured by extruding it of aluminum or other suitable material, and for this reason is provided with a hollow interior 54 so as to minimize use of material. The arcuate edge or surface 44 is also preferably provided with one or more small grooves 55 extending lengthwise thereof for decorative purposes.

With the structural relationships possessed by the corner bracket (such as bracket 21) and the corner trim element 41, the trim element is adapted to be positioned within the corner recess 39 by being longitudinally slidably inserted into and hence retained within the corner bracket. This slidable insertion of the trim element 41 into the recess 39 is accomplished by initially aligning the corner element 41 adjacent one end of the corner bracket and then relatively slidably inserting the trim element 41 into the recess, such being permitted inasmuch as the securing ribs 33 and 37 slidably cooperate with the grooves 46 and 48 so as to provide an assembled relationship as illustrated by FIG. 3. When in this latter relationship, the corner element 41 is secured to the corner bracket, and the outer arcuate edge wall 44 is exposed and provides a desirable rounded corner configuration for the cabinet structure.

With the corner element 41 disposed within the corner bracket, it will normally be vertically retained merely by its abutment with the base 18, or in the alternative by providing a suitable internal stop at the lower end of the corner bracket. Further, by forming the corner element 41 from several individual elongate pieces, several individual pieces can be slidably inserted into the corner bracket so as to be vertically stacked on top of one another to create the overall height of the cabinet. This facilitates either insertion or removal of the elements 41, even when the overall cabinet structure is of significant height, without creating a dimensional or spacial interference problem with the ceiling.

Figure 4:
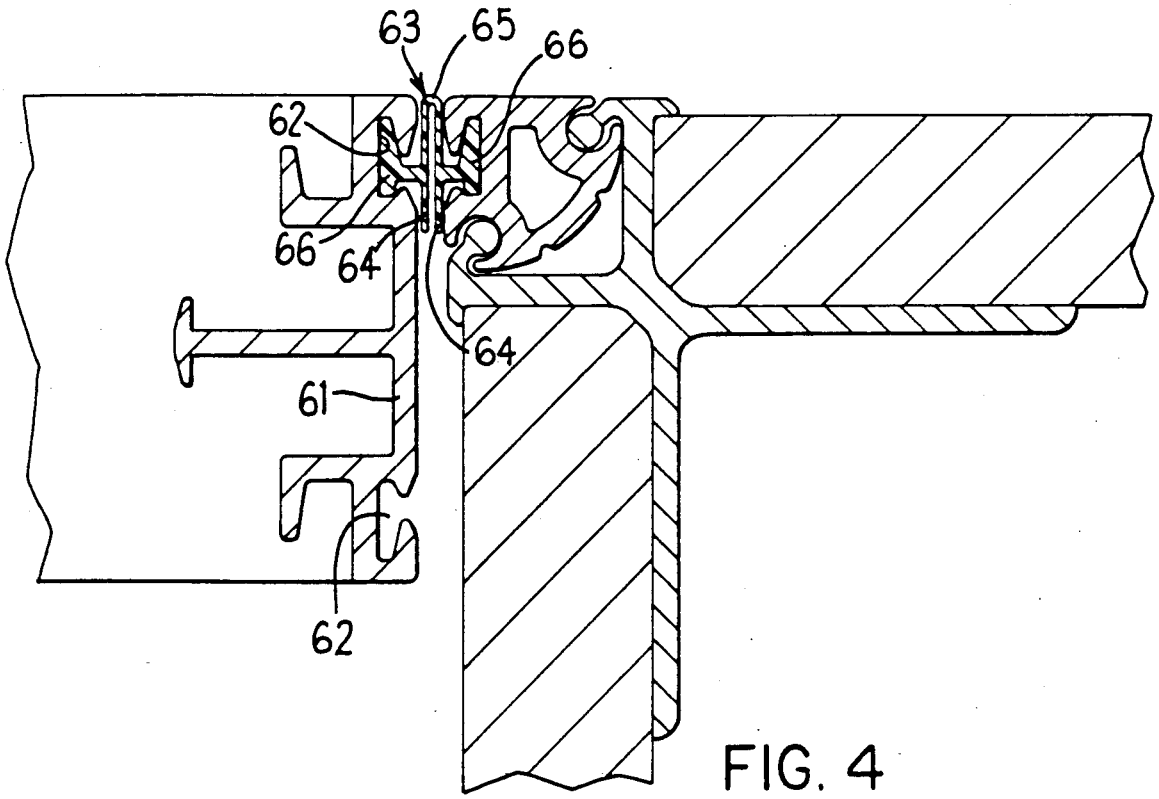
FIG. 4 is an enlarged fragmentary sectional view of the circled area designated "4" in FIG. 2.

If it desired to provide the cabinet structure with a more conventional square corner, then the corner element 41 can be slidably removed from the respective corner bracket, following which the corner element is rotated 180° about its longitudinal vertical axis, and then slidably reinserted into the corner bracket so as to assume a position substantially as illustrated by FIG. 4. In this reoriented position, the securing ribs 33 and 37 again are slidably accommodated and retained by the grooves 46 and 48 so as to securely retain the corner bracket and corner element together. In this orientation, however, the arcuate edge surface 44 is now disposed interiorly of the corner recess 39, and instead the flat edge surfaces 42 and 43 are now outermost so as to effectively function as outer surfaces of the cabinet structure. In fact, these outer flat edge surfaces 42 and 43 now substantially align with the outer surfaces defined by the flanges 31, and the corner 45 of the element 41 effectively functions as the outer vertical corner of the cabinet structure.

With the corner element 41 in the square-corner configuration illustrated by FIG. 4 (as contrasted to the round-corner configuration of FIG. 3), the corner element 41 can now also be utilized to permit secure attachment between the cabinet structure and an adjacent furniture component, such as the panel 11. The panel 11 includes a vertically elongate edge cap 61 secured to and extending along the vertical edge thereof. This edge cap, adjacent each side of the panel, has a generally L- or T-shaped groove 62 formed therein, which groove has generally the same configuration as the groove 51 described above, and which extends generally vertically throughout the height of the edge cap. Each of the grooves 62, which open in the endwise direction of the panel, are adapted to receive one-half of a vertically elongate connecting hinge structure so as normally permit securement of two horizontally adjacent upright wall panels. This manner of securing adjacent upright wall panels is conventional, and is described in greater detail in U.S. Pat. No. 3 990 204, as owned by the Assignee of this application.

More specifically, FIG. 4 illustrates therein a conventional hinge-type connecting structure 63 as typically used to join a horizontally adjacent pair of upright space divider panels. The hinge-type connecting structure 63 includes a pair of generally flat hinge plates 64 joined by a vertically elongate hinge 65 (i.e., a living hinge). Each hinge plate has a generally L- or T-shaped hinge part 66 projecting sidewardly therefrom and adapted for vertical slidable securement within one of the grooves 62. The hinge-type connecting structure 63 is conventionally extruded of a plastics material.

With the corner element 41 disposed in its square-corner position as illustrated by FIG. 4, the cabinet structure can be disposed so that it is positioned directly adjacent one vertical edge of a panel 11, with the cabinet structure projecting into the space and in fact occupying the space which would normally be occupied by the next adjacent panel. The cabinet structure thus in effect takes that place of a panel when positioned as illustrated by FIG. 4, in which positional relationship the groove 51 in the corner element 41 is disposed in directly opposed relationship to one of the grooves 62 on the panel end cap. Hence, the hinge type connection structure 63 can then be vertically slidably inserted into the opposed grooves 51 and 62 substantially as illustrated by FIG. 4 so as to securely join the adjacent cabinet structure and panel together. It will be apparent that the opposite rear corner of the cabinet can be similarly joined to another panel, whereby the cabinet structure in effect takes the place of but functions as one of a horizontally aligned series of connected panels. Alternatively, one of the front corner elements could be disposed in its square-corner orientation and joined to a further panel projecting outwardly therefrom so that the cabinet structure would effectively be disposed at a corner for joining two perpendicularly extending panel series.

Figure 5:
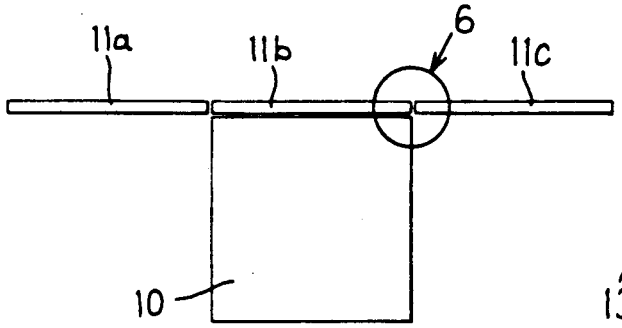
FIG. 5 is a top outline view showing an alternative arrangement wherein three panels are connected in series and have a cabinet structure positioned in front of one of the panels.
Figure 6:
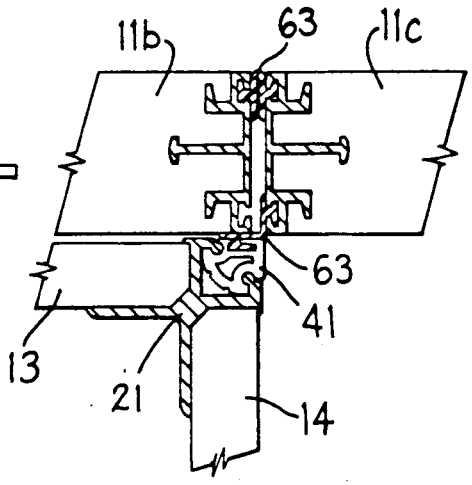
FIG. 6 is an enlarged fragmentary sectional view of the area designated by the circle "6" shown in FIG. 5.

Another possible variation is illustrated by FIGS. 5 and 6 wherein three panels 11*a*, 11*b* and 11*c* are horizontally connected in series, with the adjacent panels being joined together by conventional hinge-type connecting structures 63, such as illustrated by FIG. 6. In this arrangement, the cabinet 10 is positioned so that the rear side thereof sits directly adjacent and in front of the panel 11*b*, rather than being disposed within the panel alignment. In this situation the corner element 41 can again be disposed in its square-corner orientation as illustrated by FIG. 6, and the hinge element 63 can be utilized for joining the element 41 to one of the adjacent panels by orienting the hinge in the open or 90° position substantially as illustrated.

Referring now to FIG. 7, there is illustrated a further variation with respect to the manner of use of the cabinet structure of the present invention. More specifically, in this variation two similar cabinets 10 and 10' are positioned in adjacent relationship so that sides thereof are disposed in directly adjacent and opposed relationship. When so oriented, the outer or nonadjacent corners can be disposed with the corner elements 41 in their rounded-corner positions so as to define rounded exposed corners on the cabinets. However, the adjacent corners of the two cabinets are disposed with the corner elements 41 in their square-corner positions whereby the adjacent corner elements 41 define a generally flat flush surface which is effectively coextensive with or only slightly forwardly offset from the adjacent flat sides of the cabinets, thereby providing a more desirable appearance. Further, when in this orientation, the adjacent corner elements 41 are disposed so that the grooves 51 are disposed in directly opposed relationship, and the hinge-type connecting elements 63 are then slidably inserted into the opposed grooves to thus fixedly connect the adjacent corners of the cabinets together, this connection being made at both opposed pairs of corners. This provides for structural integrity between the two cabinets for visual and spacial purposes, and in addition allows the connecting structure 63 to effectively cooperate with the opposed corner elements 41 to function as a light blocker to prevent transmission of light between the cabinets.

It will be appreciated that the connecting of the adjacent lowermost pair of corner elements 41 illustrated in FIG. 7 could also be utilized if the cabinets were oriented in an adjacent diagonal relationship, such as illustrated by the dotted line position of the cabinet 10' in FIG. 7 and its relationship to the cabinet 10.

Figure 8A:
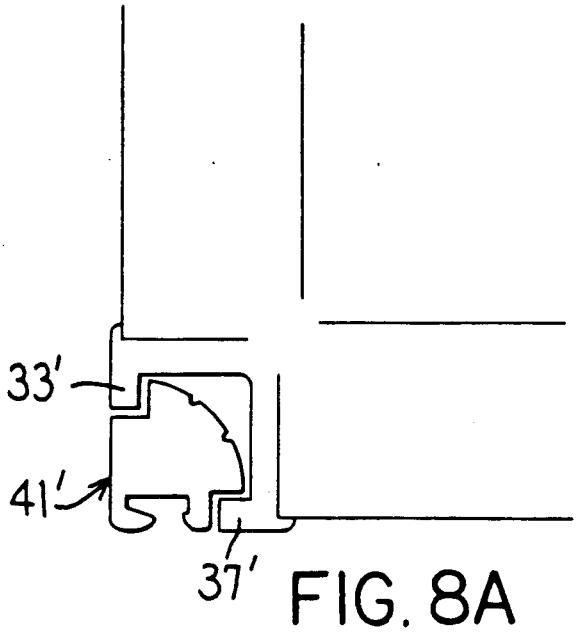
FIGS. 8 and 8A are sectional views showing a variation of the invention.
Figure 8:
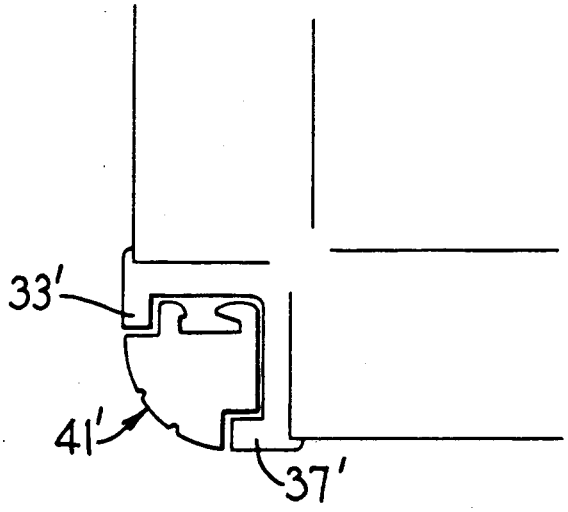

Referring now to FIGS. 8 and 8A, there is illustrated a variation relative to the corner bracket and the associated corner element. In this variation, the overall structure of both the corner bracket and corner element are the same except that the securing ribs 33' and 37' project generally perpendicularly outwardly from the respective platelike leg and are accommodated within corner grooves which are of generally rectangular configuration in that they open outwardly through both the arcuate side surface and the respective flat side surface, with the securing ribs functioning as an extension of the outer surface of the corner member whether disposed in its rounded-corner position of FIG. 8 or in its square-corner position of FIG. 8A.

While the removable corner element 41 of the present invention is desirably longitudinally slidably secured within the corner bracket according to the preferred embodiment as illustrated and described herein, nevertheless it will be appreciate that other arrangements for permitting removable securement of the corner member to the bracket can be provided.

Further, while the cabinet structure as illustrated herein utilizes a removable corner element 41 associated with all four corners of the cabinet housing, it will be appreciated that such is not absolutely required, and that the removable and alternatively positionable corner element could be provided only on one or more selected corners if desired.

In addition, while the furniture component 10 has been illustrated and described as a cabinet structure such as a storage cabinet or a bookcase, it will be appreciated that the corner arrangement of the present invention is also equally applicable for use on numerous other furniture component such as desks so as to permit two similar or dissimilar furniture components (such as a desk and a wall panel) to be secured together in adjacent relationship.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an upright furniture component including a housing defining first and second vertical sides which extend in substantially perpendicular relation to one another, the housing having a vertically extending corner structure located substantially at the intersection of said first and second sides, the improvement wherein said corner structure comprises:

a corner recess extending vertically along said corner structure and opening horizontally outwardly relative to said furniture component;

vertically elongate corner element means removably positioned within said corner recess for defining a visible corner of said furniture component, said corner element means defining thereon a round corner structure on one side thereof and a square corner structure on the other side thereof; and means cooperating between said corner structure and said corner element means for selectively removably securing said corner element means to said corner structure in a first position wherein only said round corner structure is visibly exposed or a second position wherein only square corner structure is visibly exposed.

2. A furniture component according to claim 1, wherein said square corner structure is defined by first and second generally flat vertical side faces which extend in approximately perpendicular and intersecting relationship to one another, and wherein said round corner structure is defined by a rounded convex face which extends between outer ends of said first and second faces.

3. A furniture component according to claim 2, including groove means formed in said corner element means and extending vertically thereof, said groove means opening outwardly through one of said first and second faces and having an undercut enlarged groove portion, said groove means being adapted to receive therein a securing element for permitting attachment to another furniture component.

4. A furniture component according to claim 1, wherein said cooperating means includes cooperating vertically-elongate ribs and grooves on said corner structure and said corner element means for permitting the corner element means to be relatively vertically slidably engaged with the corner structure while preventing relative horizontal separation therebetween.

5. A furniture component according to claim 4, wherein said square corner structure is defined by first and second generally flat vertical side faces which extend in approximately perpendicular and intersecting relationship to one another, and wherein said round corner structure is defined by a rounded convex face which extends between outer ends of said first and second faces.

6. A furniture component according to claim 5, including groove means formed in said corner element means and extending vertically thereof, said groove means opening outwardly through one of said first and second faces and having an undercut enlarged groove portion, said groove means being adapted to receive therein a securing element for permitting attachment to another furniture component.

7. A furniture component according to claim 1, wherein said corner structure includes a corner bracket having first and second platelike legs which are disposed in general vertical planes and which generally perpendicularly intersect so that the legs project horizontally in generally perpendicular relationship to one another and define said corner recess therebetween, said corner element means being removably positioned within said corner recess.

8. A furniture component according to claim 7, wherein said cooperating means includes a securing rib fixed to each of said platelike legs in the vicinity of the free edge thereof and projecting in transverse and cantilevered relationship sidewardly from the respective leg generally into said corner recess, and said corner element means having groove means extending longitudinally thereof for accommodating said securing ribs to horizontally secure said corner element means to said corner structure while permitting relative vertical sliding therebetween.

9. In an upright storage cabinet having a housing of generally rectangular horizontal cross section defined by first and second generally parallel sides which are perpendicularly joined by third and fourth generally parallel sides, the housing having an enlarged opening associated with at least one of the sides for providing access to the housing interior, and said housing having a corner structure associated with and extending generally vertically along each vertically extending corner of the housing, said corner structure comprising:

a vertically elongate corner bracket fixed to said housing and having a generally L-shaped horizontal cross section defined by first and second platelike legs which generally perpendicularly and rigidly intersect, said legs projecting outwardly relative to said housing away from the point of intersection and terminating in free ends which are disposed in close proximity to an outer surface of the respective sides of the housing, said first and second legs defining therebetween an outwardly opening recess which extends generally vertically of said cabinet;

a vertically elongate corner trim element positioned within said corner recess for defining a visible exterior corner of said cabinet, said trim element having first and second peripheral surfaces on opposite sides thereof which are of different horizontal profiles; and securing means cooperating between said corner bracket and the respective corner trim element for permitting said corner trim element to be selectively horizontally retained within said corner recess in either first or second positions wherein said first and second peripheral surfaces respectively of the corner trim element are visible and define the exterior corner surface of the cabinet;

said securing means including vertically elongate rib-and-groove means cooperating between said corner bracket and said corner trim element for permitting relative vertical sliding movement therebetween to permit mounting and demounting of the corner trim element on the corner structure in either of said first and second positions.

10. A cabinet according to claim 9, wherein said second peripheral surface has a horizontal profile which is of a substantially right-angle configuration defined by first and second generally flat surfaces which substantially perpendicularly intersect at a corner, said corner trim element having vertically elongate undercut groove means formed therein and extending vertically therealong, said undercut groove means opening outwardly through one of said first and second flat surfaces, and said first peripheral surface having a horizontal profile which is of a generally rounded convex configuration and which extends generally between outer ends of said first and second flat surfaces.

11. In combination, first and second upright furniture components disposed in closely adjacent sideward relationship to one another;

said first furniture component including a housing defining first and second vertical sides which extend in substantially perpendicular relation to one another, the housing having a vertically extending corner structure located substantially at the intersection of said first and second sides, said corner structure including means fixed to said housing and defining a corner recess which extends vertically of said corner structure and opens horizontally outwardly thereof, said corner structure also including vertically elongate corner element means removably positioned within said corner recess for defining a visible corner of said furniture component, said corner element means defining thereon first and second corner arrangements on generally opposite sides thereof, and means cooperating between said recess defining means and said corner element means for selectively removably securing said corner element means to said recess defining means in a first position wherein only said first corner arrangement is visible or a second position wherein only said second corner arrangement is visible, and first groove means formed in said corner element means and extending vertically therealong, said first groove means opening horizontally outward through only one of said corner arrangements so as to be accessible only when said one corner arrangement is positioned so as to be visible;

said second furniture component including an upright element positioned adjacent said corner element means and having second groove means formed therein and extending vertically therealong, said second groove means opening horizontally outwardly of said vertical element in generally close proximity to the opening of the groove means formed in said corner element means; and vertically elongate securing means extending between and being engaged within said first and second groove means.

12. A combination according to claim 11, wherein said securing means comprises a vertically elongate hinge member defining a vertical hinge axis.

13. A cabinet-panel combination, comprising:

an upright space-divider panel having height and length dimensions which are relatively large while having a small horizontal thickness dimension, the panel having a vertically extending edge member which defines an outer surface which faces in the lengthwise direction of the panel, said edge member defining therein adjacent opposite sides thereof a pair of vertically elongate undercut grooves which open outwardly through said outer surface;

an upright cabinet structure having horizontal width and depth dimensions which are both substantially greater than the horizontal thickness dimension of the panel, said cabinet structure having a vertically extending corner which is disposed in close proximity to the edge member on said panel;

said corner being defined by a corner structure which includes means fixedly associated with a housing defining said cabinet for defining a corner recess which opens horizontally outwardly at the corner and which extends vertically throughout substantially the height of the cabinet, and a vertically elongate corner element which is removably positioned within said corner recess for defining the exterior visible configuration of the corner, said vertically elongate corner element defining thereon first and second corner surfaces which are of different horizontal profiles and which extend vertically of the corner element, said corner element being selectively positionable within said recess in either a first horizontal orientation wherein said first surface is exposed or in a second horizontal orientation wherein said second surface is exposed;

said corner structure including securing means cooperating between said corner element and said corner means for permitting said corner element to be secured within said corner recess in either of said first and second positions;

said corner element having an undercut groove formed therein and extending vertically thereof, said undercut groove opening outwardly through said second surface so as to be exteriorly visible only when said corner element is mounted in said second position; and a vertically elongate securing element for horizontally joining the edge member on said panel and said corner structure for maintaining the corner of said cabinet structure in horizontally close proximity to the edge member on said panel, said securing element having a first securing part which is vertically engaged within one of the undercut grooves on said edge member and a second securing part which is vertically engaged within the undercut groove on said corner element.

14. A combination according to claim 13, wherein said cabinet structure has a second corner which extends vertically thereof and is positioned in horizontally spaced relation from said first-mentioned corner, said second corner being defined by a corner structure which includes corner means defining an outwardly opening recess for removably mounting therein a second corner element, said second corner element being substantially identical to said first-mentioned corner element and being selectively mountable in said second corner means in either of said first and second positions; and said first-mentioned corner member being mounted in its respective corner recess in said second position so that said second surface is exposed and is engaged with said securing element, and said second corner member being mounted within its respective corner recess in said first position so that said first surface is exposed.

15. A combination according to claim 14, wherein said first surface is of a generally rounded convex configuration in horizontal profile, and wherein said second surface is of a generally right-angle configuration in horizontal profile.

16. A combination according to claim 15, wherein said securing element comprises a hinge member having a vertically extending hinge axis defined between the first and second securing parts.

* * * * *